US005254838A

United States Patent [19]

Hasegawa et al.

[11] Patent Number: 5,254,838

[45] Date of Patent: Oct. 19, 1993

[54] IGNITER FOR ELECTRIC IGNITION SYSTEMS

[75] Inventors: Hitoshi Hasegawa; Hirokazu Kobari; Junichi Kishimoto, all of Shirakawa; Nakaba Nakamura; Akihito Tamura, both of Kyoto, all of Japan

[73] Assignees: Nippon Koki Co., Ltd., Tokyo; Susumu Co., Ltd., Kyoto, both of Japan

[21] Appl. No.: 847,859

[22] Filed: Mar. 9, 1992

Related U.S. Application Data

[63] Continuation of Ser. No. 714,337, Jun. 12, 1991, abandoned, which is a continuation of Ser. No. 243,489, Sep. 12, 1988.

[30] Foreign Application Priority Data

Sep. 14, 1987 [JP] Japan ..... 62-230463

[51] Int. Cl.[5] ..... H05B 3/00

[52] U.S. Cl. ..... 219/270; 219/543; 219/539; 219/552; 219/260; 338/309; 123/145 A

[58] Field of Search ..... 219/270, 544, 522, 543, 219/535, 511, 552, 512, 260, 539; 123/145 A, 145 R; 338/308, 309

[56] References Cited

U.S. PATENT DOCUMENTS

| | | | |
|---|---|---|---|
| 3,816,702 | 6/1974 | Green | 219/543 |
| 3,903,393 | 9/1975 | Stapleton et al. | 219/543 |
| 4,096,510 | 6/1978 | Arai et al. | 219/543 |
| 4,259,564 | 3/1981 | Ohkubo et al. | 219/543 |
| 4,433,233 | 2/1984 | Hierholzer, Jr. et al. | 219/270 |
| 4,733,056 | 3/1988 | Kojima et al. | 219/270 |
| 4,816,643 | 3/1989 | Zulauf et al. | 219/270 |

FOREIGN PATENT DOCUMENTS

| | | | |
|---|---|---|---|
| 7402600 | 9/1974 | Netherlands | 219/270 |

*Primary Examiner*—Mark H. Paschall
*Attorney, Agent, or Firm*—Kalish & Gilster

[57] ABSTRACT

An igniter for electric ignition systems is made up of intergrally formed terminals and heating elements of metal thin film. Therefore, it maintains its stable ignition performance, high safety, and high reliability over a long period of time even in a severe environment. The heating element is covered with a protective coating film made of an inorganic material to ensure good heat conduction and to maintain the initial performance over a long period of time.

4 Claims, 4 Drawing Sheets

IGNITER FOR ELECTRIC IGNITION SYSTEMS

This application is a continuation of application Ser. No. 07/714,337, filed Jun. 12, 1991, now abandoned, which is a continuation of Ser. No. 07/243,489, filed Sep. 12, 1988, which is pending.

BACKGROUND AND SUMMARY OF THE INVENTION

The present invention relates to an igniter for electric ignition systems used for electric detonators and automotive air bag gas generators.

The conventional type of igniter for electric ignition systems used for the above-mentioned applications is made up of two lead wires 11, with their ends functioning as a pair of terminals 13, and a heating element 15 disposed between the paired terminals 13, as shown in FIG. 8. The heating element 15 is a fine platinum wire or nichrome wire having a high electric resistance, and it is bonded and connected to the terminals 13 with solder or electrically conductive adhesive 17. When turned on, this type of igniter for electric ignition systems 18 permits an electric current to flow through the high-resistance heating element 15 via the conductors 11 of the lead wires and the terminals 13, generating heat in the heating element 15 as the result of conversion from electric energy into thermal energy.

The above-mentioned conventional type of igniter for electric ignition systems 18 may be used for an electric detonator (electric ignition system) as shown in FIG. 9, in which the reference numeral 19 denotes two lead wires to supply an electric current. Between the ends of the conductors 11 of the lead wires 19 is disposed the igniter for electric ignition systems 18. Around the igniter for electric ignition systems 18 is disposed the priming charge 21. On the priming charge 21 is disposed the blasting powder 23. The lead wires 19 and the priming charge 21 are surrounded by the insulation resin 25 and 26, respectively, which prevent the priming charge 21 from being ignited by static electricity. When triggered, the electric detonator mentioned above permits an electric current to flow through the lead wires 19 and the igniter for electric ignition systems 18. The electric current generates thermal energy which ignites the priming charge 21 which, in turn, explodes the blasting powder 23.

In the meantime, as the speed of automobiles increases, the development of the safety air bag is going on for the reduction of shocks to the driver in the event of an accident. The safety air bag is inflated by a pyrotechnic gas generator. The igniter 18 for the gas generator is required to have a high reliability so that it never works when the car is in the normal state but generates a gas instantaneously for the reduction of shocks to the driver in the event of an accident. In the conventional safety air bag, this reliability is achieved by providing the igniter 18 with two or three heating elements 15 arranged in parallel so that ignition takes place certainly even in the case where one of the heating elements 15 is disconnected from the terminal 13.

The conventional ignitier 18 mentioned above has a disadvantage that there is no way to confirm that the fine heating element 15 is firmly connected to the terminal 13 of the lead wire 19 because the connection is made with adhesive or solder. It has another disadvantage that there is a possibility that the heating element 15 is disconnected from the terminal 13 while the air bag is left unused for a long period of time in an environment where there are considerable temperature changes, vibrations, and shocks. With the heating element disconnected, the igniter does not work.

For the conventional igniter 18 to be highly reliable, it is necessary that the igniter 18 be provided with two or three heating elements arranged in parallel. This creates difficulties of making the fine heating elements uniform in resistance and igniting performance.

The present invention was completed to solve the above-mentioned problems. Accordingly, it is an object of the present invention to provide an igniter for electric ignition systems which maintains its high reliability even in a severe environment.

The gist of the present invention resides in an igniter for electric ignition systems which comprises a pair of terminals of metal thin film formed and disposed a certain distance apart on the surface of a thin insulating board and at least one heating element of metal thin film which integrally connects said terminals to each other.

The gist of the present invention resides also in an igniter for electric ignition systems which comprises a pair of terminals of metal thin film formed and disposed a certain distance apart on the surface of a thin insulating board and at least one heating element of metal thin film which integrally connects said terminals to each other, said heating element being covered with a protective coating film of inorganic thin film.

According to the present invention, the terminals and heating elements are integrally made of metal thin film. This structure permits an electric current to flow through the terminals and heating element certainly and to generate heat in a short time because of the small mass of the heating element.

According to the present invention, the heating element is covered with a protective coating film made of an inorganic material to ensure good heat conduction and to maintain the initial performance over a long period of time.

DESCRIPTION OF PREFERRED EMBODIMENTS OF THE INVENTION

Example of the Invention

Figure 1:
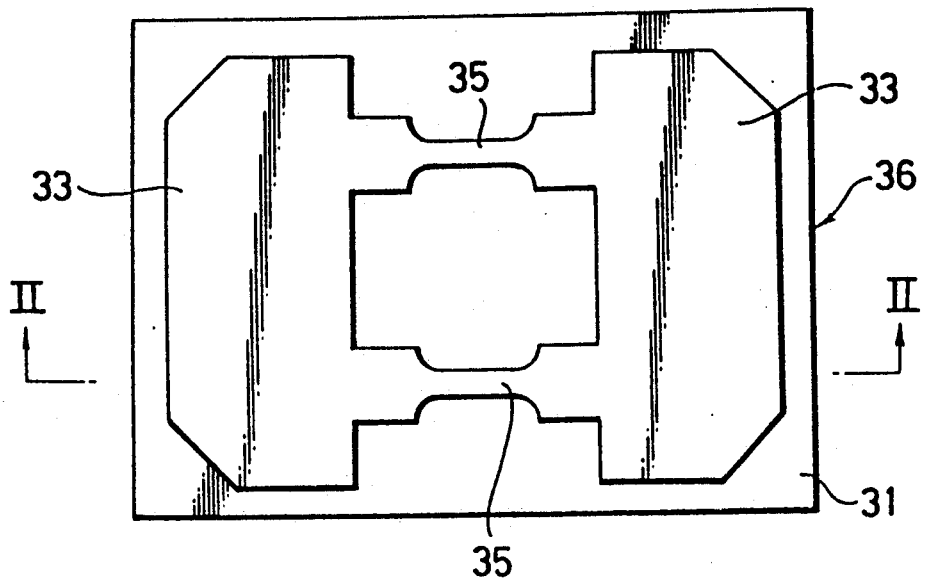
FIG. 1 is plan view showing the igniter for electric ignition systems in one example of the present invention.

The invention will be describe in more detail with reference to one embodiment illustrated in the drawing.

FIG. 1 is a plan view showing one embodiment of an igniter, generally designated 36 for electric ignition systems pertaining to the present invention. In FIG. 1, the reference numeral 31 denotes a rectangular thin insulating board, about 0.6 mm thick, made of ceramics. This thin insulating board may be replaced by an insulation layer formed on a glass plate or metal plate.

On the thin insulating board 31 are disposed a pair of terminals 33 at a certain distance apart, and between the paired terminals 33 are disposed two heating elements 35. The terminals 33 and the heating elements 35 are integrally made of metal thin film.

Figure 2:
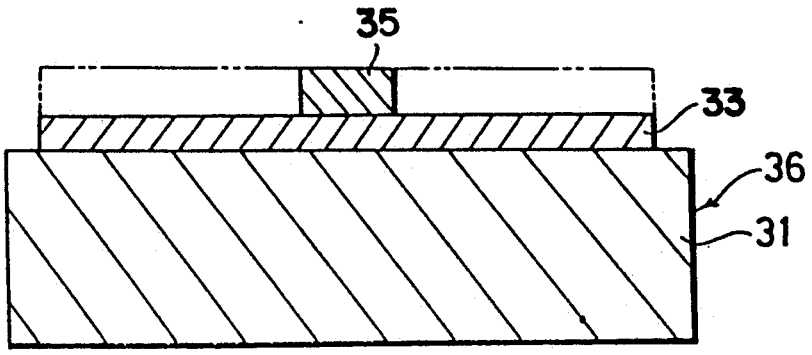
FIG. 2 is a longitudinal sectional view taken along the line II—II in FIG. 1.

FIG. 2 is a longitudinal sectional view of the igniter 36 taken along the line II—II in FIG. 1. There are shown the thin insulating board 31 and the terminals 33 and heating elements 35 of nichrome, tantalum nitride, or other metal thin film formed thereon. Incidentally, the terminals 33 and heating elements 35 may be of single-layered structure or multiple-layered structure.

When triggered, the igniter 36 constructed as mentioned above permits an electric current to flow through the terminals 33 and heating elements 35, generating heat in the heating elements 35.

The igniter for electric ignition systems mentioned above is produced in the following manner. At first, the thin insulating board 31 of ceramics is entirely coated with metal thin film, 500 to 5000 Å thick, by the sputtering method or vacuum deposition method. The metal thin film is subjected to photo-etching to remove the unnecessary part indicated by the chain line in FIG. 2. Thus the terminals 33 and heating elements 35 of metal thin film are integrally formed as shown in FIG. 1.

Figure 8:
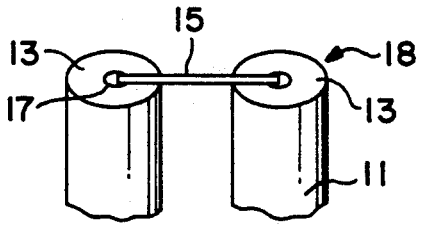
FIG. 8 PRIOR ART
FIG. 8 is a perspective view showing a conventional igniter.
Figure 9:
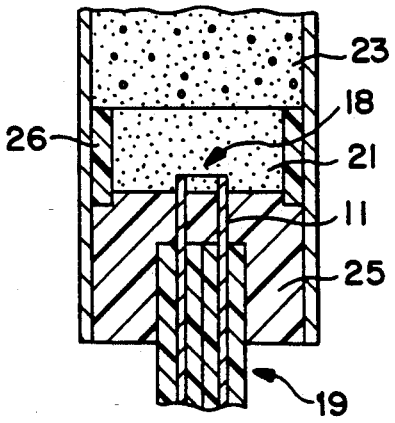
FIG. 9 PRIOR ART
FIG. 9 is a longitudinal sectional view showing a conventional igniter applied to an electric detonator.

The igniter 36 for electric ignition systems constructed as mentioned above differs from the conventional one in that it is not necessary to bond the fine heating element 15 to the terminals 13 of lead wires with solder or electrically conductive adhesive as shown in FIG. 8. According to this invention, the terminals 33 and heating elements 35 are integrally formed on the thin insulating board 31. Therefore, the heating element 35 works certainly to generate heat even in a severe environment. This leads to the reliability of the igniter 36 for electric ignition systems.

According to the deposition and etching processes, it is possible to form the terminals 33 and heating elements 35 in an extremely small size, and it is also possible to arrange fine heating elements 35 in parallel. Thus this manufacturing process permits the easy production of the extremely small, highly reliable igniter 36 for electric ignition systems.

Figure 3:
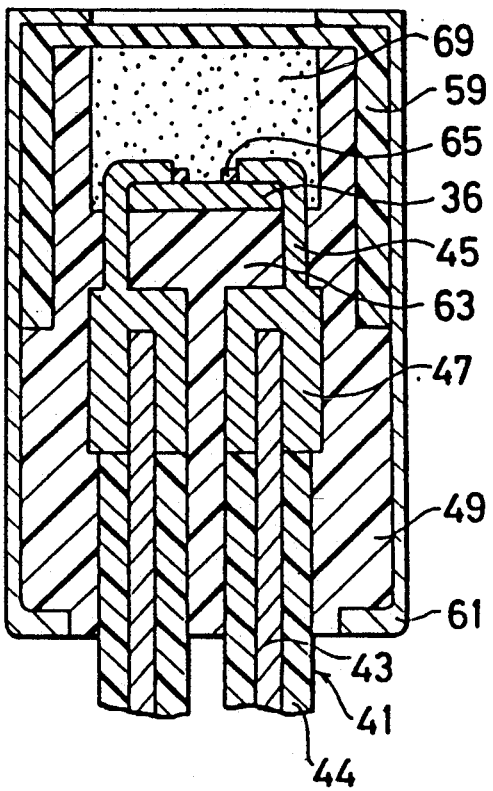
FIG. 3 is a longitudinal sectional view showing the igniter of the present invention applied to the gas generating system to inflate an air bag.

FIG. 3 is a longitudinal sectional view of the igniter for electric ignition systems pertaining to the present invention which is applied to an air bag gas generator (not shown). The reference numeral 41 indicates the lead wire for an electric current.

Figure 4:
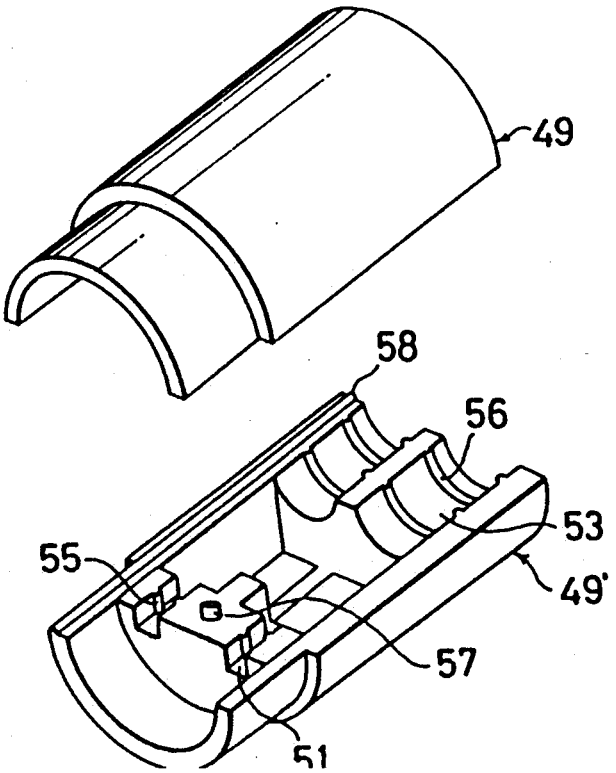
FIG. 4 is a perspective view showing the plug proper shown in FIG. 3.

The lead wire 41 is made up of the conductor 43, which is a tin-plated soft copper wire, and the covering 44 of crosslinked polyethylene. The end of the conductor 43 of the lead wire 41 is connected to the solderless terminal 47 of oxygen-free copper having the projecting part 45. The solderless terminal 47 and the lead wire 41 are fixed to the plug proper 49 made of insulating resin such as polyethylene, polyvinyl chloride, and Ryton. The plug proper 49 is composed of two split parts as shown in FIG. 4. The part 51 to hold the solderless terminal has the projection 55 for pressing, and the part 53 to hold the lead wire has the projection 56 for pressing. When the two parts of the plug proper 49 are joined together, the projection 55 presses the projecting part 45 of the solderless terminal 47 in place and the projection 56 presses the lead wire 41 in place.

To facilitate the joining of the two halves of the plug proper 49, one half is provided with the semicylindrical fitting piece 57 and the other half, the hole (not shown) to receive the fitting piece 57. In addition, to facilitate the joining of the two halves of the plug proper 49 by ultrasonics, each half is provided the V-shaped rib 58 on one side thereof.

The upper part of the joined plug proper 49 is provided with the fitting cap 59 (FIG. 3) made of an insulating resin such as polyethylene, polyvinyl chloride, and Ryton. The plug assembly composed of the plug proper 49 and the cap 59 is protected by the plug case 61 made of aluminum, iron, or stainless steel.

At the center 63 of the plug assembly is disposed the above-mentioned igniter 36. On the thin insulating board 31 of the igniter 36 are integrally formed the terminal 33 and heating element 35 by deposition. The terminal 33 is fixed to the center 63 of the plug assembly by bending the end of the projecting piece 45 of the solderless terminal 47. The end of the projecting piece 45 is bonded to the terminal 33 with solder 65. The igniter 36 is firmly bonded to the center 63 of the plug with an epoxy adhesive.

Figure 5:
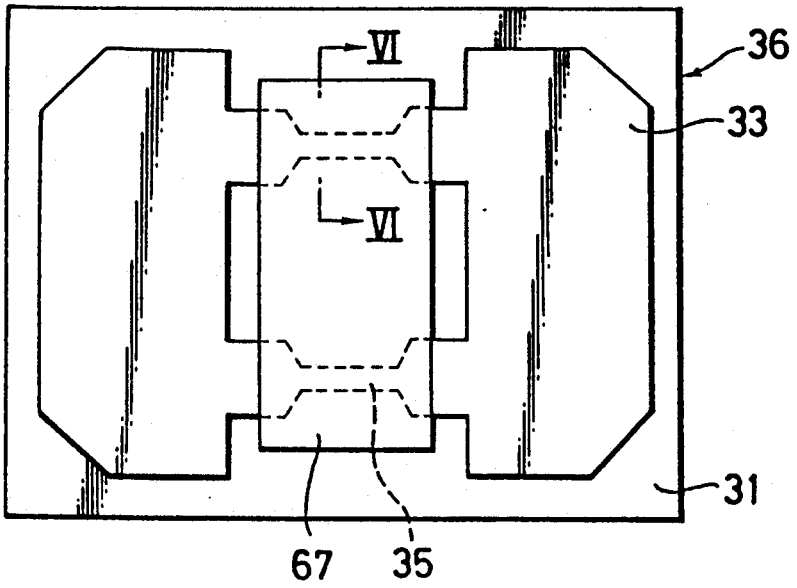
FIG. 5 is a plan view showing the heating element as shown in FIG. 3, with the protective coating film formed thereon.
Figure 6:
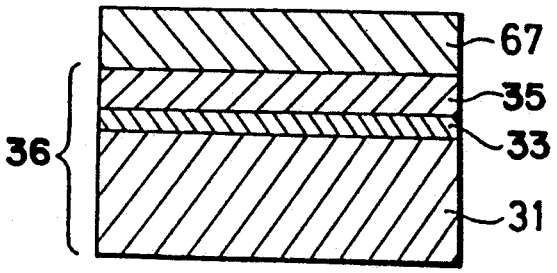
FIG. 6 is a sectional view taken along the line VI—VI in FIG. 5.
Figure 7:
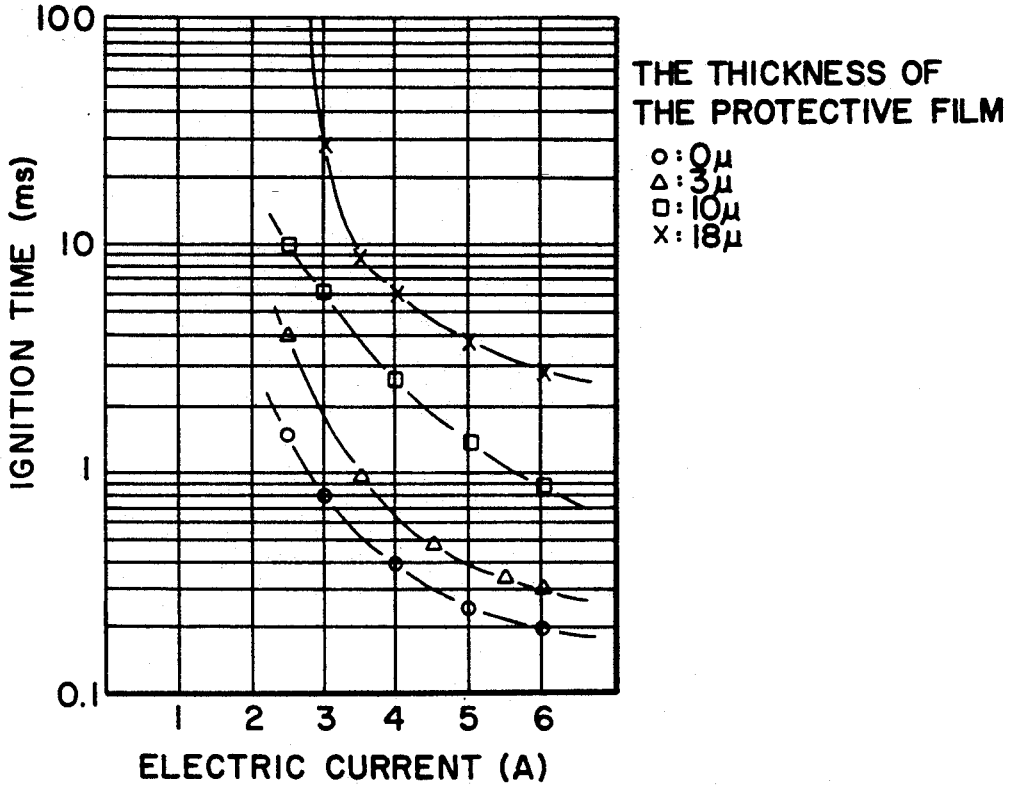
FIG. 7 is a graph showing the relationship between the thickness of the protective coating film and the ignition time.

The top of the heating element 35 is covered with the protective coating film 67, about 3 μm thick, made of inorganic thin film such as silicon oxide and silicon nitride, as shown in FIGS. 5 and 6. The protective coating film 67 of desired shape as shown in FIG. 5 is formed by deposition through plasma reaction or the like and then dry etching with a gas. The protective film 67 controls the ignition time according to its thickness. Experimental results indicate that the thicker the protective coating 67, the longer the ignition time as shown in FIG. 7.

The upper part of the plug proper 49 is filled with the priming charge 69 (FIG. 3) such as tricinate, lead rhodanide and potassium chlorate, diazonitrophenol, and barium styphnate. In other words, the priming charge 69 is on the protective coating film 67.

The igniter 36 constructed as mentioned above is installed in the ignition system for the air bag gas generator. When triggered, the igniter permits an electric current to flow through the conductor 43 of the lead wire 41, the solderless terminal 47, the terminal 33, and the heating element 35 having a smaller surface area. The electric current generates heat in the heating element 35. The heat ignites the priming charge 69 placed on the heating element 35, and the priming charge 69 melts the top of the cap 59 and ignites the blasting powder (not shown). The blasting powder generates a gas to inflate the air bag instantaneously.

The air bag ignition system constructed as mentioned above has many advantages as follows: The cap 59 fitting to the plug proper 49 keeps the priming charge 69 in the plug proper 49 and prevents spark discharge which is otherwise induced between the solderless terminal 47 and the plug case 61 by static electricity. The lead wire 41 and the solderless terminal 47 are protected from being pulled out or bent, because the lead wire 41 is pressed in place by the pressing projection 56 formed in the lead wire holder 53 and the projecting piece 45 of the solderless terminal 47 is pressed in place by the pressing projection 55 formed in the solderless terminal holder 51. The protective coating film 67 separates the heating element 35 from the priming charge 69, thereby protecting the heating element 35 from corrosion, breakage, and change in resistance which would otherwise occur when the priming charge 69 deteriorates. It is possible to properly change the thickness of the protective coating film 67, the surface area and material of the heating element 35, and the kind of the priming charge 69 according to the desired performance of the igniter 36. This contributes to the high safety and reliability even in a severe environment. The igniter 36 is fixed by bending the end of the projecting piece 45 of the solderless terminal 47 and the projecting piece 45 is fixed to the terminal 33 on the thin insulating board 31 with solder. This connecting method is easier and certainer than the conventional direct connecting method, and contributes to high safety and reliability even in a severe environment.

In the above-mentioned example, the lead wire 41 is connected to the igniter 36 through the solderless terminal 47. Alternatively, the conductor 43 of the lead wire 41 may be connected directly to the terminal 33 of the igniter 36 without the solderless terminal 47.

It goes without saying that the igniter for electric ignition systems pertaining to the present invention may be used for electric detonators and firearms as well as the gas generating system to inflate an air bag.

The igniter for electric ignition systems pertaining to the present invention has the heating element which is narrower than the part adjoining the terminal 33 so that the heating element generates a prescribed amount of heat. The number of the heating elements may be one or two or more according to the object, although it is two in the above-mentioned example. The heating element as shown in FIG. 1 is used for the ignition system in which the heating element is not subject to peeling and corrosion, and the heating elements as shown in FIG. 5 is used for the ignition system in which the heating elements is subject to peeling and corrosion.

As mentioned above, the igniter of the present invention is made up of integrally formed terminals and heating elements of metal thin film. Therefore, it maintains its stable ignition performance, high safety, and high reliability over a long period of time even in a severe environment.

What is claimed is:

1. An electronic ignition system comprising (a) a pair of conductors, (b) a pair of solderless terminals, each having a projecting part, connected to the conductors, (c) an ignitor connected to the projecting parts of the solderless terminals, (d) a primary charge on top of and in contact with the ignitor, (e) a cap on top of the primary charge, and (f) a plug assembly in contact with the cap and encasing the conductors and solderless terminals, wherein the ignitor comprises a thin insulating board and disposed on the board is a pair of terminals at a certain distance apart and between the terminals are disposed multiple heating elements, wherein on top of the heating elements is a protective coating film or inorganic thin film, wherein the igniter, when triggered, permits an electric current to flow through the conductors, the solderless terminal, the terminals and the heating elements, generating heat and thereby igniting the primary charge which melts the top of the cap.

2. The electronic ignition system of claim 1, wherein the heating elements of the ignitor are a metal thin film.

3. An igniter for electric ignition systems, said igniter comprising a pair of terminals of metal thin film formed and disposed a certain distance apart on the surface of a thin insulating board and multiple heating elements of metal thin film which integrally connect said terminals to each other, said heating elements being covered with a protective coating film of inorganic thin film, wherein there are multiple heating elements arranged parallel to each other and perpendicular to the terminals, wherein the igniter, when triggered, permits an electric current to flow through the terminals and through the heating elements, thereby generating heat in the heating elements, and wherein the protective coating film of inorganic thin film has a thickness of approximately three microns to thereby permit an ignition time of less than one millisecond.

4. An igniter for electric ignition systems, said igniter comprising a pair of terminals of metal thin film formed and disposed a certain distance apart on the surface of a thin insulating board and multiple heating elements of metal thin film which integrally connect said terminals to each other, said heating elements being covered with a protective coating film of inorganic thin film, wherein there are multiple heating elements arranged parallel to each other and perpendicular to the terminals, wherein the igniter, when triggered, permits an electric current to flow through the terminals and through the heating elements, thereby generating heat in the heating elements, and wherein the protective coating film of inorganic thin film is formed of silicon oxide and has a thickness of approximately three microns.

* * * * *